US009975725B2

(12) United States Patent
De Marco

(10) Patent No.: US 9,975,725 B2
(45) Date of Patent: May 22, 2018

(54) PROCESS AND SYSTEM FOR THE PRODUCTION OF BOOKS WITH DIGITAL PRINTING AND RESPECTIVE BOOK

(71) Applicant: Tecnau S.r.l., Ivrea (TO) (IT)

(72) Inventor: Giuliano De Marco, Ivrea (IT)

(73) Assignee: Tecnau S.r.l., Ivrea (IT)

( * ) Notice: Subject to any disclaimer, the term of this patent is extended or adjusted under 35 U.S.C. 154(b) by 0 days. days.

(21) Appl. No.: 15/330,780

(22) Filed: Nov. 7, 2016

(65) Prior Publication Data

US 2017/0190187 A1 Jul. 6, 2017

Related U.S. Application Data

(63) Continuation-in-part of application No. 14/313,062, filed on Jun. 24, 2014, now Pat. No. 9,487,373.

(30) Foreign Application Priority Data

Jun. 24, 2013 (IT) ..... TO2013A0516

(51) Int. Cl.
*B65H 35/04* (2006.01)
*B41J 3/28* (2006.01)
(Continued)

(52) U.S. Cl.
CPC ..... *B65H 35/04* (2013.01); *B41J 3/28* (2013.01); *B42C 9/0006* (2013.01); *B42C 19/06* (2013.01); *B42D 1/002* (2013.01); *B65H 29/00* (2013.01); *B65H 37/00* (2013.01); *B65H 37/06* (2013.01); *B65H 45/08* (2013.01); *B65H 45/10* (2013.01); *B65H 45/22* (2013.01); *B65H 35/0006* (2013.01); *B65H 35/0013* (2013.01)

(58) Field of Classification Search
CPC ..... B65H 35/0013; B65H 37/06; B65H 35/0006; B65H 35/04; B65H 37/00; B65H 45/08; B65H 45/10
USPC ..... 270/5.02, 52.17, 52.09, 16; 412/8, 37; 281/15.1
See application file for complete search history.

(56) References Cited

U.S. PATENT DOCUMENTS 6,010,122 A * 1/2000 Weber ..... B65H 35/02 270/32
8,425,389 B2 * 4/2013 Dobrovolsky ..... B31F 1/0025 493/320
2014/0116212 A1 * 5/2014 DeMarco ..... B65H 35/02 83/13

* cited by examiner

*Primary Examiner* — Leslie A Nicholson, III
(74) *Attorney, Agent, or Firm* — Banner & Witcoff, Ltd.

(57) ABSTRACT

A process for the production of books (22) with digital printing from signatures, in which the book comprises signature groups (33), each formed with basic sheets (34), are parts of respective signature sheets (42). The process employs a manufacturing system (21) which includes a transversal cutting equipment (41) for cutting transversally the signatures sheets, and transversal and longitudinal folding equipment (46) for the formation of respective signatures (48). For a book with at least a sheet section devoid of text and/or figures in a last signature group, the method provides: a) identify a reduced signature group (59) including a number of sheet sections having at least a page with text and/or figures; b) cut the paper strip (23) to separate the reduced signature group as reduced signature group; c) actuate the transversal folding equipment (46) limited to the sheet sections having at least a page with text and/or figures and skipping the actuation of the transversal folding equipment (46) for a single sheet section; and d) actuate the longitudinal folding equipment (47) for folding longitudinally the reduced signature group.

16 Claims, 9 Drawing Sheets

(51) Int. Cl.

| | |
|---|---|
| ***B42D 1/00*** | (2006.01) |
| ***B42C 9/00*** | (2006.01) |
| ***B42C 19/06*** | (2006.01) |
| ***B65H 29/00*** | (2006.01) |
| ***B65H 45/22*** | (2006.01) |
| ***B65H 45/08*** | (2006.01) |
| ***B65H 37/06*** | (2006.01) |
| ***B65H 45/10*** | (2006.01) |
| ***B65H 37/00*** | (2006.01) |
| *B65H 35/00* | (2006.01) |

PROCESS AND SYSTEM FOR THE PRODUCTION OF BOOKS WITH DIGITAL PRINTING AND RESPECTIVE BOOK

RELATED APPLICATION

This application claims priority to Italian Application No. TO2013A000516 filed Jun. 24, 2013, and entitled "Process and system for the production of books with digital printing from a continuous paper strip, and respective book", the content of which is incorporated herein by reference in its entirety. This application is also a Continuation-in-part application of U.S. Ser. No. 14/313,062 filed Jun. 24, 2014, which is hereby incorporated by reference in its entirety.

FIELD OF THE INVENTION

The present invention relates to improvements to a process for the production of books with digital printing, a system for its implementation and book formed in accordance with that process.

More specifically, the invention relates to a process for the production of books with digital printing, a system for its implementation and a book formed in accordance with the process of the invention. Each book comprises a number of signature groups, each formed with a given number of basic sheets.

BACKGROUND OF THE INVENTION

Typically, a book comprises a plurality of sheets with printed pages, stacked on one another and which constitute a block book, and a cover bounded with the block book. In manufacturing systems for books "on demand", the printing is performed on both sides of a continuous paper strip and defines book sections in sequence. Each book section is associated to a book and is different from the preceding and the following section in the case of books with different titles. The paper strip is of origin for basic sheets of the block book, which are separated by transversal cuts and, possibly, by longitudinal cuts and are processed individually in operations of stacking and preparation of the block books, subsequently trimmed. The above mentioned manufacturing systems allow to process customer orders quickly and efficiently, with fidelity to the original editing of the books but, ceteris paribus, the operating speed of the system is negatively affected by the number of transversal cuts on the continuous strip.

According to an editorial technique by signatures and specific editing, the basic sheets of a book are derived from "signatures" obtained, by folding, from respective signature sheets. By way of example, a signature in 8° corresponds to a transversal fold in a half of a signature sheet, followed by a longitudinal fold. A signature in 12° corresponds to a transversal fold in a half of a signature sheet, followed by two zig-zag longitudinal folds. Signatures in 16° and in 24° can be obtained with a second fold. In the lines of the folds, the sheets of the books are then separated in a trimming step. This technique by "signatures" allows to obtain book blocks with ease and a number of loose sheets reduced with respect to the number of sheets required to form the same basic block with basic sheets cut individually.

The technique by signatures can be applied to produce books, specifically, but not exclusively "books on demand" with printing on a continuous paper strip. The paper strip maintains the configuration of book sections arranged in sequence: each book section is constituted by signature sheets, each formed with a predetermined number of basic sheets, while the number of signature sheets depends on the number of pages in the book. The transversal cuts required for the basic sheets are reduced, resulting in a greater speed of the system.

In particular, the continuous paper strip is processed by a book manufacturing system, which includes a transversal cutting equipment for cutting the strip and separating the basic sheets, in groups, as signature sheets and a transversal folding equipment for transversally folding the separated signature sheets. A longitudinal folding equipment folds longitudinally the previously folded signature sheets, forming respective signatures and a stacking and gluing device stacks then the signatures, forming a basic book block for subsequent treatments.

The technique by signatures can be also applied to produce books, specifically, but not exclusively "books on demand" with printing on cut paper sheets of origin for the signature sheets. The signature sheets define book sections in sequence associated to respective books. Also in this case, each signature sheet is formed with a predetermined number of basic sheets and the number of signature sheets depends on the number of pages in the book.

For manufacturing books "on demand" by signatures of the above defined types, and fidelity to the original editing of the printed pages, the last signature of the book block, and the finished book can be constituted by a large number of blank pages. This, in addition to constitute a waste of paper, is not considered favorably by the editorial market.

On the other hand, the formation of signature sheets with a smaller number of basic sheets, for example by forming the signatures only with a row of flanked basic sheets, would increase the number of transversal cuts, giving rise to a consequent reduction of the operating speed of the system.

SUMMARY OF THE INVENTION

An object of the present invention is to provide a process and a system for the manufacturing of books, in particular but not exclusively "books on demand", with signatures which, without cost increase or reduction of productivity and maintaining the original editing of the pages, reduce or cancel the number of paper devoid of print in the last signature of the book. Each book comprises a number of signature groups, each formed with a given number of basic sheets, which are parts of respective signature sheets forming the signature group.

In accordance with this object, the process for the production of books with digital printing of the above defined type comprises steps: a) identifying in the signature groups a reduced signature group including a number of sheet sections having at least a page with text and/or figures, for a book in which the part regarding a last signature group has at least a sheet section devoid of text and/or figures of the book to be manufactured; b) actuating a transversal cutting equipment for cutting a last sheet of the signature sheets so as to separate, as reduced signature sheet, the sheet section having at least a page with text and/or figures; c) processing the reduced signature sheet for a signature with reduced number of sheets by actuating the transversal folding equipment limited to the sheet sections having at least a page with text and/or figures or skipping the actuation of the transversal folding equipment for a single sheet section; and d) stacking the signature with reduced number of sheets on the other signatures for completing a basic book block of the book to be manufactured.

According to another object, the production system of the invention comprises a perforating equipment for longitudinal and transversal perforations of the cut sheets, a transversal cutting equipment, a transversal folding equipment, a longitudinal folding equipment and a stacking device. Each book comprises a number of signature groups formed with a given number of basic sheets, the basic sheets are parts of respective signature sheets forming the signature groups and the signature sheets are constituted by the cut sheets. The cut sheets are arranged in a stack for more books and in which the transversal folding equipment and, if requested, the longitudinal folding equipment are actuatable for transversal and longitudinal folds of the signature sheets. The system further comprising a program such to: a) identifying in said signature groups a reduced signature group including a number of sheet sections having at least a page with text and/or figures, for a book in which the part regarding a last signature group has at least a sheet section of the last signature sheet devoid of text and/or figures of the book to be manufactured; b) actuating the perforating equipment for perforating the signature groups and, if present, the reduced signature group in weakening lines provided for the folds of the signatures; c) actuating the transversal cutting equipment for cutting a last sheet of the signature sheets so as to separate, as reduced signature sheet, the sheet section or the sheet sections having at least a page with text and/or figures; d) processing the reduced signature sheet for a signature with reduced number of sheets by actuating the transversal folding equipment limited to the sheet sections having at least a page with text and/or figures or skipping the actuation of the transversal folding equipment for a single sheet section; e) actuating, if requested, the longitudinal folding equipment for longitudinal folding or leaving longitudinally unfolded the reduced signature sheet, as signature with reduced number of sheets; and f) stacking the signature with reduced number of sheets on the other signatures for completing a basic book block of the book to be manufactured.

In accordance with a further object, a book produced by a system for manufacturing books with print on both the sides of a paper strip or cut sheets and organized by book sections and sheet sections comprises a number (SBN−1) of signatures each one formed with a given number (SSN) of basic sheets and an end signature with a reduced number of sheets when the part of the book sections regarding the last signature has at least a sheet section without pages with text and/or figures.

BRIEF DESCRIPTION OF THE DRAWINGS

The characteristics of the invention will become clear from the following description, given purely by way of non-limiting example, with reference to the appended drawings in which.

DESCRIPTION OF THE PREFERRED EMBODIMENTS

First Embodiment of the Invention

Figure 1:
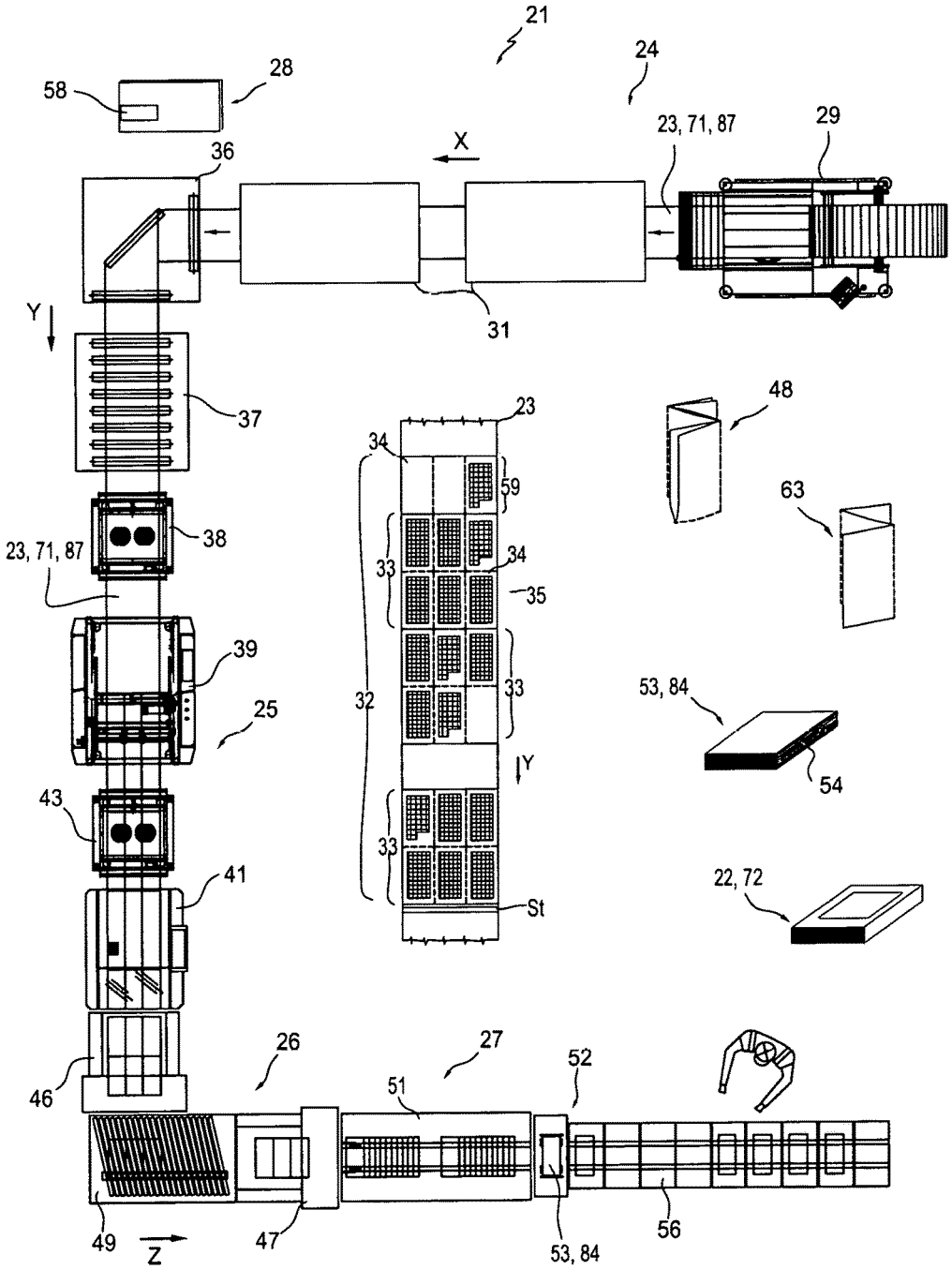
FIG. 1 represents a schematic plan view of a book manufacturing system with digital printing from a continuous paper strip in accordance with a first embodiment of the invention.
Figure 2:
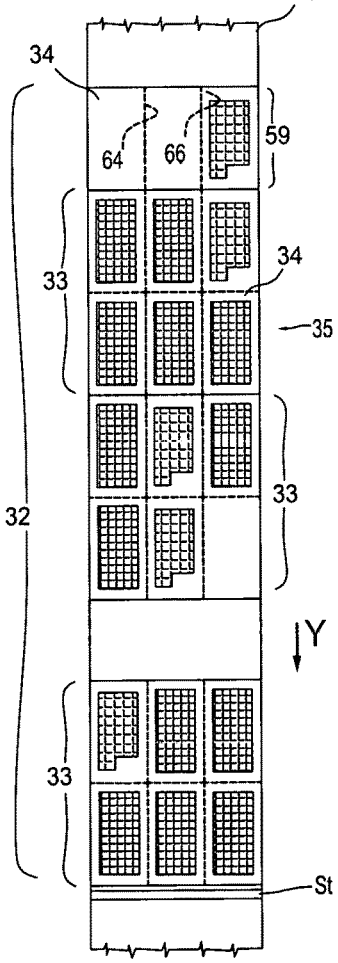
FIG. 2 is a sketch of the continuous paper strip used in the book manufacturing system of FIG. 1.
Figure 3:
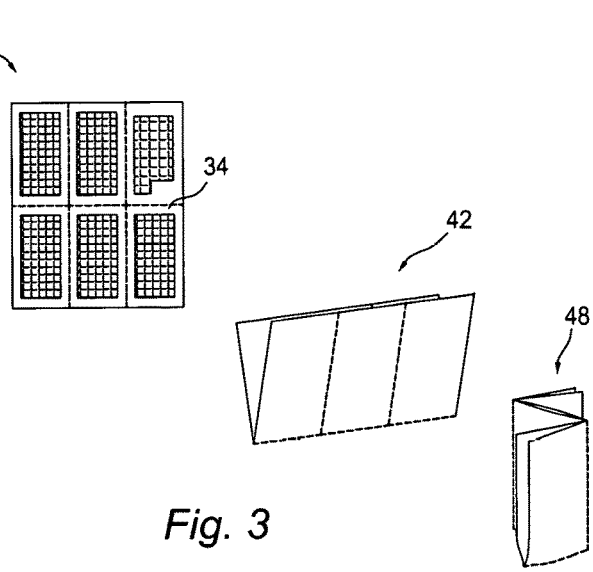
FIGS. 3 and 4 show parts of the paper strip of FIG. 2 and respective changes during the process for the production of books in accordance with the first embodiment of the invention.
Figure 4:
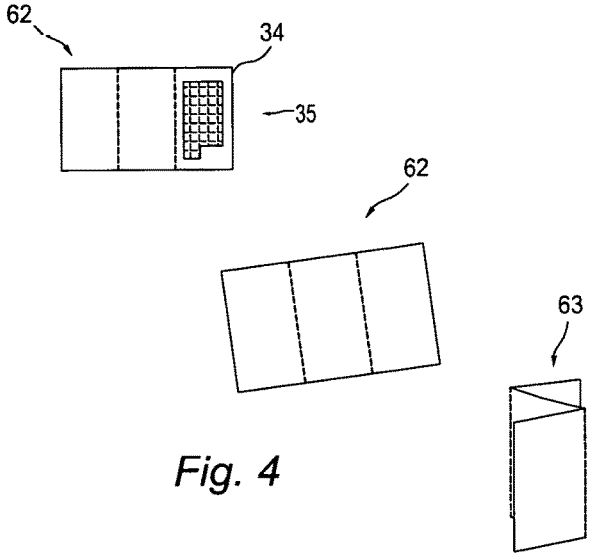
Figure 5:
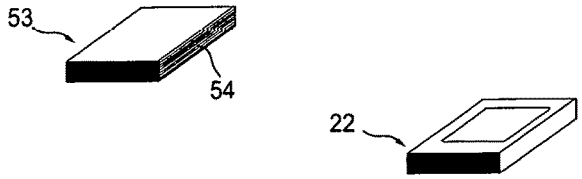
FIG. 5 represents schematic views of a book block during the process for the production of books of the invention.
Figure 6:
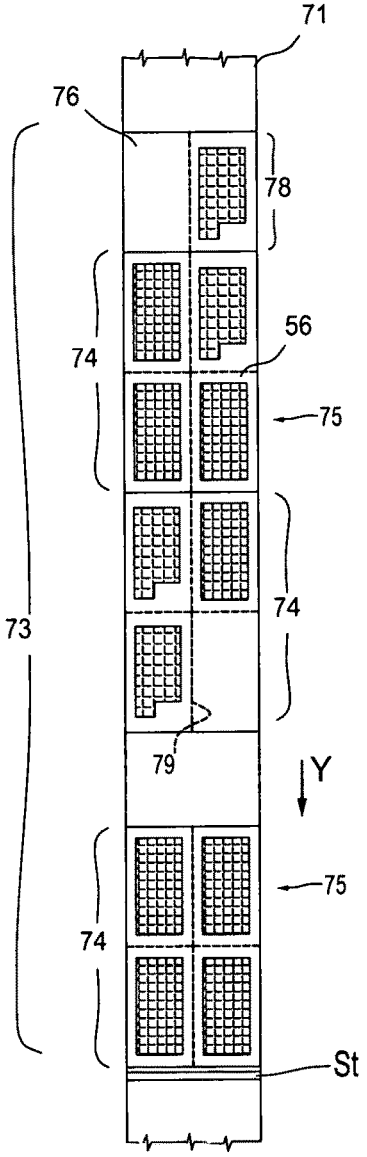
FIG. 6 is a sketch of another paper strip used in the production system of FIG. 1.
Figure 7:
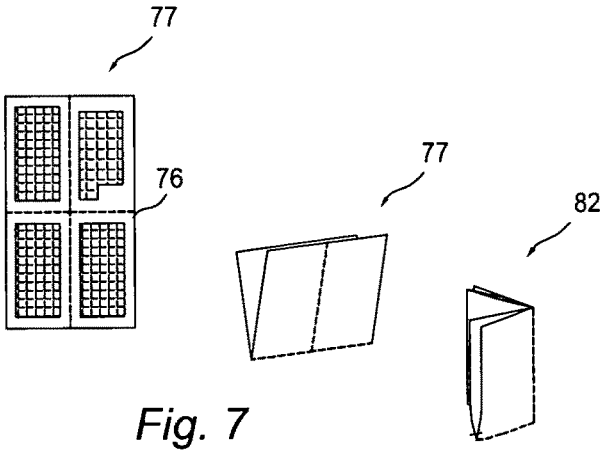
FIGS. 7 and 8 show parts of the strip of FIG. 6 and respective changes during the process for the production of books in accordance with the first embodiment of the invention.
Figure 8:
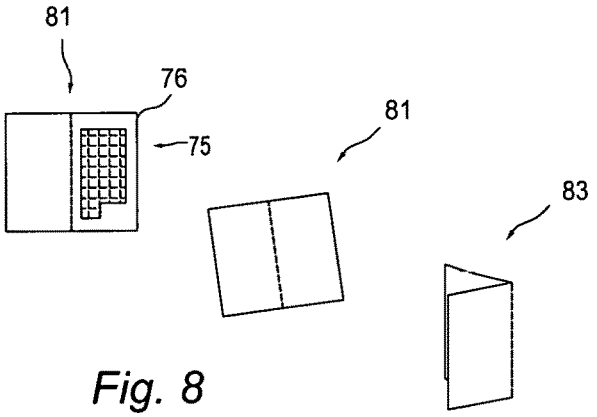
Figure 9:
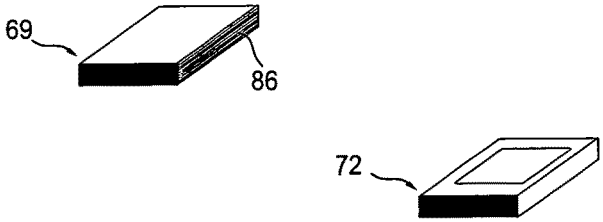
FIG. 9 represents schematic views of another book block during the process for the production of books of the invention.

FIGS. 1 and 2 show a book manufacturing system 21 according to a first embodiment of the invention. The system 21 manufactures books 22 with digital printing on a continuous paper strip 23 and a technique by signatures. The signatures are constituted by signature sheets separated from the continuous strip 23 and folded by the components of the system both transversally and longitudinally.

In summary, the book manufacturing system 21 comprises an unwinding and printing station 24 and other kinematic components including a perforating and cutting station 25, a dynamic signature forming station 26 and a collecting and pre-assembling station 27. The system 21 operates on the basis of information on the books to be printed, supplied from a database, and a program 28 comprising parts of coordination and control for the stations 24, 25, 26 and 27.

The continuous paper strip 23 is wrapped in coil and defines a longitudinal axis corresponding, as not limiting example, to the longitudinal axes of the signature sheets, after their separation. The unwinding and printing station 24 includes an unwinder 29 for unwinding the strip 23 and a printing equipment 31. The unwinder 29 and the printing equipment 31 are aligned with the longitudinal axis of the strip 23 and operate with a substantially continuous feed of the strip along a direction of advancement "X". The printing equipment 31 is of a high-speed type and provides for digitally printing text and figures of the books to be manufactured on the two sides of the strip 23.

In extreme synthesis, the program 28 controls the printing equipment 31 so as to define book sections 32, which are arranged in sequence along the longitudinal axis of the strip and contain the data of the text and figures of the books to be manufactured. Each book section 32 is associated to a specific book 22 and includes a number SBN of signature groups 33 in which each signature group is formed by a given number SSN of basic sheets 34 with printed text and/or figures on the two sides of the paper strip 23. Each book section 32 also identifies sheet sections 35 formed by flanked basic sheets, which can be separated with a single cut from the continuous strip 23.

Each book section 32 defines a start area indicated with "St". The program 28 provides to the printing on the area "St" of optically readable codes, which include, inter alia, information regarding the start of the book section and the number of the respective sheets. Moreover, in association with the sheets, the program causes the printing of synchronization bars and codes with information regarding the sequential number of the sheets, and the positions of the perforations, the cuts and the folds for the execution of the signatures. The codes are readable by suitable code readers of the various equipments of the system for providing information for the executions of the respective operative functions.

The book manufacturing system 21 can operate, however, without departing from the scope of the invention, with treatment programs of information having a centralized organization of the data or with codes different from what was previously summarized.

Downstream from the printing equipment 31, the system 21 includes a deflecting device 36, a buffering device 37 and a loop device 38. The deflecting device 36 deflects of 90°, along a direction "Y", the paper strip 23 emerging from the printing equipment 31 along the axis "X". In turn, the buffering device 37 and the loop device 38 have function of compensation, with accumulation, for different instantaneous speeds of the strip between the printing equipment 31 and the other kinematic components of the system 21.

The perforating and cutting station 25 comprises a dynamic perforating equipment 39 and a transversal cutting equipment 41. The perforating equipment 39 perforates the strip 23 in the longitudinal direction and in the transversal direction along weakening lines of the basic sheets 34 provided for the folds, for making easy the folding of the sheets in the steps of formation of the signatures. In particular, the equipment 39 performs a transversal perforation to facilitate the folding of the signature sheet perpendicular to the longitudinal axis and one or more longitudinal perforations to facilitate a fold or more folds of the signature sheet parallel to the longitudinal axis.

The perforating equipment 39 is, for example, of the type described in the Italian Patent IT 1.344.097 of Tecnau Srl, with setting of the transversal perforation pitch depending on the format of the book. The perforations are effected on the fly while the paper strip is in continuous motion. For the longitudinal perforations, the equipment 39 comprises a plurality of pairs of perforating discs. The discs are arranged transversally to the strip 23, in positions associated with the possible lines of longitudinal folds on the signature sheets, and are selectively actuatable for executing the respective perforations.

The cutting equipment 41 cuts transversely the paper strip 23, by separating the signature groups 33 sheets with more sheet sections, as signature sheets 42. The equipment 41 can provide a guillotine blade, of width suitable for the wider paper strips, and in which the strip is temporarily arrested at the moment of the cutting. A loop device 43, downstream of the perforating equipment 39, compensates for the differences in speed of the strip 23 between the perforating equipment 39 and the cutting equipment 41.

The signature forming station 26 comprises a first folding equipment, identified as a transversal folding equipment 46, an aligning and direction changing device 49 and a second folding equipment, identified as longitudinal folding equipment 47. The folding equipments 46 and 47 receive the signature sheets 42, flat or folded in overlapping, and execute controlled folds parallel to a leading edge of an entering sheet.

The aligning and direction changing device 49 aligns a leading edge of the signature sheets 42 emerging from the folding equipment 46, with abutment on a contrast surface perpendicular to the direction "Y" and deflects of 90° the direction of advance, indicated with "Z", of the signature sheets 42. Therefore, the transversal folding equipment 46 folds transversally the signature sheets 42 with respect to the axis of the strip 23 and the direction of movement "Y". The longitudinal folding equipment 47 folds the sheets 42 emerging from the equipment 46 transversally to the direction of movement "Z", but longitudinally with respect to the axis of the strip 23, forming respective signatures 48.

The collecting and pre-assembling station 27 comprises a collecting and transferring device 51 with conveyor belt, where the signatures 48 are collected and transported with partial overlap (as fish scales), and a stacking and gluing device 52 for stacking the signatures and forming a basic book block 53. At the end of the stacking, the device 52 provides to apply a layer of glue on a binding edge 54 of the basic book block 53, with stabilizing function for subsequent operations. There is also provided a conveyor belt 56, from which an operator can extract the stabilized book blocks for manual treatments, or access to a book binder. In these steps, external to the present invention, the basic book block 53 is bound to the cover and trimmed on the other edges, with separation of the sheets still joined by the folds of the signatures.

The above described manufacturing system 21 has a substantially "C" shaped plain layout, but it should be clear that the book manufacturing system of the invention can assume different configurations, for example an "L" shaped layout, by modifying or eliminating the deflecting device 36.

The perforating equipment 39, the cutting equipment 41, the folding equipments 46 and 47 and the stacking and gluing device 52 operate on the continuous paper strip 23 or on sheets separated and/or folded, on control of the program 28 and on the basis of information obtained from the codes read from the strip 23 or from a database of the system 21.

In accordance with the invention, the manufacturing system 21 operates with an optimization program 58, which is integrated with the program 28 for controlling the printing equipment 31, the perforating and cutting station 25 and the signature forming station 26 so as to reduce or avoid the number of sheets devoid of texts and/or figures in the signatures of the book 22 to be manufactured. To this end, the program 58 checks in each book section 32 the existence of incompleteness if the last signature group has sheet sections 35 devoid of texts and/or figures, which would result in a final signature with one or more sheet sections 35 with blank pages. In the case of incompleteness, the program 58 controls the printing equipment 31, by setting an identification code 59 of a reduced signature group in the book section 32.

By way of example, for signatures providing a single transversal fold for each signature, the program 58 checks if the number of basic sheets 34 devoid of texts and/or figures in the last signature group is SSN/2 or less, which would result in a final signature having SSN/2 or more blank pages.

The identification code is functional to the last signature having a number SSN/2 of basic sheets 34, which is a half of the given number of basic sheets SSN. On the basis of the identification code, the perforating equipment 39 skips the transversal perforation, while the cutting equipment 41 cuts the continuous strip 23 so as to separate the halved signature group as halved signature sheet.

Then, the program 58 processes the halved signature sheet by skipping the actuation of the transversal folding equipment 46. On the contrary, the program actuates the longitudinal folding equipment 47 for the longitudinal folding of the halved signature sheet, as a signature with halved number of sheets and proceeds with the stacking of the signature with halved number of sheets on the previously stacked signatures to complete the basic book block 53 and following treatments.

With reference to the FIGS. 2-5, the continuous strip 23 used in the manufacturing system 21 is provided for books 22 with signatures in 12°, in which each signature groups 33 is constituted by the signature sheets 42 with six basic sheets 34, for 12 pages of the book and two sheet sections 35. The sheet sections 35 are formed by three basic sheets 34 arranged side by side and the signature provides a sole transversal fold. A halved signature group 59 includes a single section sheet 35 with three basic sheets 34 for six pages of the book 22, the perforating equipment 39 executes two longitudinal perforations 64 and 66 both on the signature groups 33 and on the halved signature group 59, while the cutting equipment 41 separates from the strip 23 a halved signature sheet 62 with three basic sheets 34.

The transversal folding equipment 46 executes the transversal folds only on the signature sheets 42, while the longitudinal folding equipment 47 is provided for executing two longitudinal folds both on the signature sheets 42 with six basic sheets transversally folded, and on possible, unfolded, halved signature sheet 62.

In the FIGS. 6-9, the book manufacturing system 21 of the invention uses a continuous paper strip 71 for books 72 with signatures in 8°, having two section sheets 75 formed by two basic sheets 76 arranged side by side. The strip 71 defines book sections in sequence 73, with the start area "St" and signature groups 74 constituted by four basic sheets 76 for signature sheets 77 corresponding to eight pages of the book 72. The halved signature group, represented with 78, includes a single section sheet 75 with two basic sheets 76 for a halved signature sheet 81 and four pages of the book 72.

The perforating equipment 39 is provided for executing a longitudinal perforation 79 both on the signature groups 74 and the halved signature group 78. The transversal folding equipment 46 executes the transversal fold only on the signature sheets 77, while the longitudinal folding equipment 47 is provided for executing a longitudinal fold both on the signature sheets 77 with four basic sheets transversally folded and forming respective signatures 82, and on the possible, unfolded, halved signature sheet 81 with two basic sheets and forming a signature with halved number of sheets 83.

The process for the production of the books 72 is similar to that described for the book 22. After the longitudinal perforation, the separation, the crossing of the equipment 46 and the longitudinal fold, the program 58 also processes the signature with halved number of sheets 83 as the other signatures 82, proceeding with the stacking of the signature 83 on the previously stacked signatures 82, forming a basic book block 84 and applying a layer of glue on a binding edge 86 of the basic book block 84, in preparation of following treatments.

Suitably, the system for manufacturing 21 can also operate for manufacturing books with different signatures from a common continuous strip.

Figure 10:
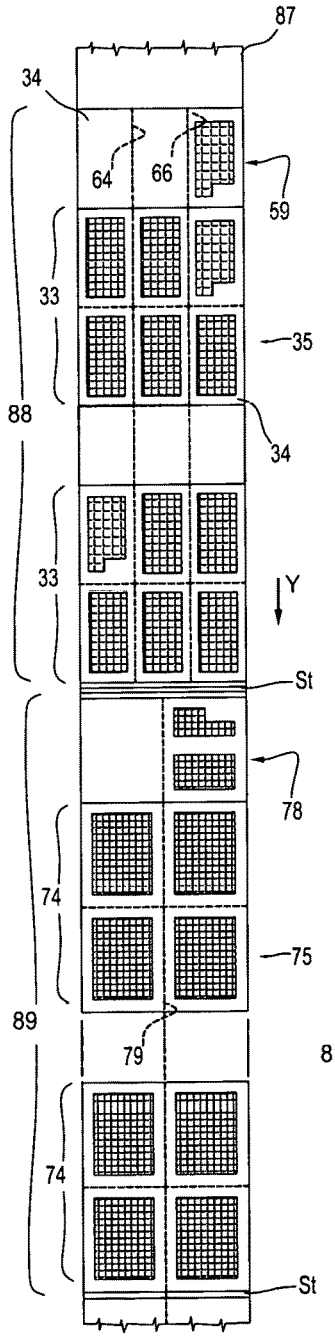
FIG. 10 is another sketch of the continuous paper strip used in the book manufacturing system of FIG. 1.
Figure 11:
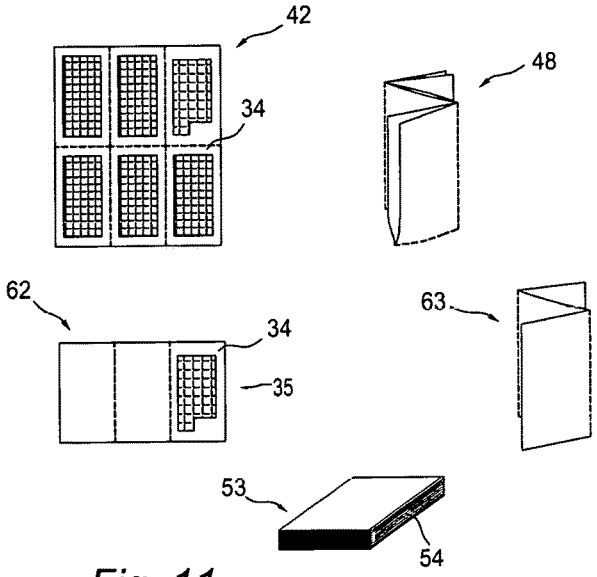
FIGS. 11 and 12 show parts of the strip of FIG. 10, respective changes and parts of books during the process of the invention.
Figure 12:
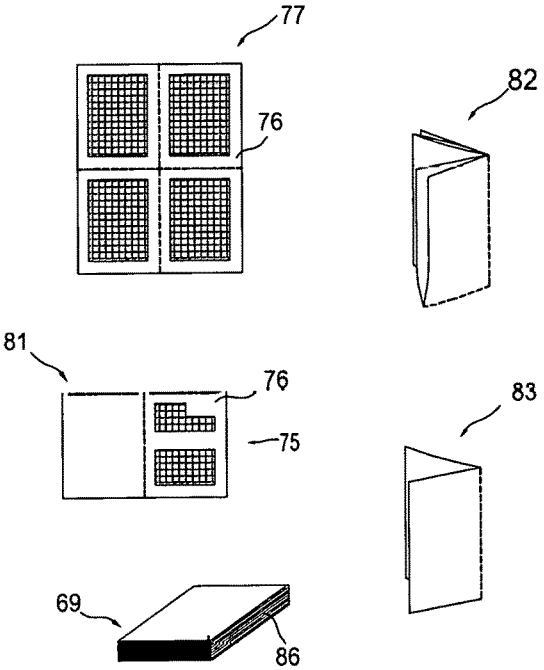

In the FIGS. 10-12, the system 21 of the invention uses a continuous paper strip 87 for books with signatures in 12° and for books with signatures in 8°. The strip 87 defines in sequence book sections 88 and book sections 89 both with the respective start area "St". The book section 88 includes signature groups 33 of six basic sheets 34 equal to the book sections 32 of FIG. 2, the sheet sections 35 with three basic sheets 34 and the halved signature group 59 with three basic sheets 34. The book sections 89 include signature groups 74 of four basic sheets 76, equal to the book sections 74 of FIG. 6 and the sheet sections 75 with two basic sheets 76. The halved signature group, represented with 78, has two basic sheets 76 for a halved signature sheet 81, a signature with halved number of sheets 83 and four pages of the book 72.

In the perforating equipment 39, the pairs of longitudinal perforating disks are selected and actuated on control of the program 58 for defining the longitudinal perforations 64 and 66 or 79. For the signature groups 33 with six basic sheets, the program selects the two pairs of disks positioned transversally in the positions provided for the perforations 64 and 66. For signature groups with four basic sheets 74, the program 58 selects individually the pair of disks of the transversal position provided for the execution of the perforation 79.

The transversal folding equipment 46 and the longitudinal folding equipment 47 can be of a "buckle chute folder" type including input rollers and more folding pockets (elements not shown in the figures), which can be selected by suitable deflectors controlled by the program 58 for executing folds of the signature sheets in the requested positions. Moreover, the transversal folding equipment 46 can be set up for causing the halved signature sheets to transit without folds.

The system 21 (FIGS. 13-15) can also operate with signatures which provide more than a transversal fold on each signature sheet, for instance two transversal folds on signatures in 16° and in 24°. This feature is associated to a corresponding book section on the respective control codes.

By elaborating the information of the database, the program 58 identifies, in each book section, sheet sections formed by the basic sheets, in which each sheet section is separable from the continuous strip with a single cut. For a book in which the last signature group has at least a sheet section without pages with texts and/or figures, the program defines a reduced signature group, including a number of sheet sections having at least a page with texts and/or figures. Hence, the program causes the printing in the book section of a respective code of incompleteness for the processing of the reduced signature groups.

Figure 13:
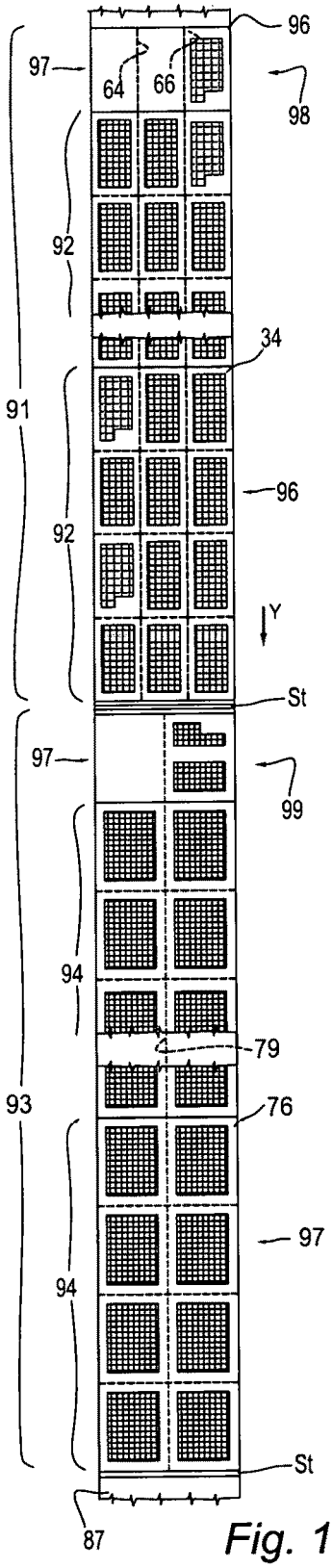
FIG. 13 is a further sketch of the continuous paper strip used in the book manufacturing system of FIG. 1.
Figure 14:
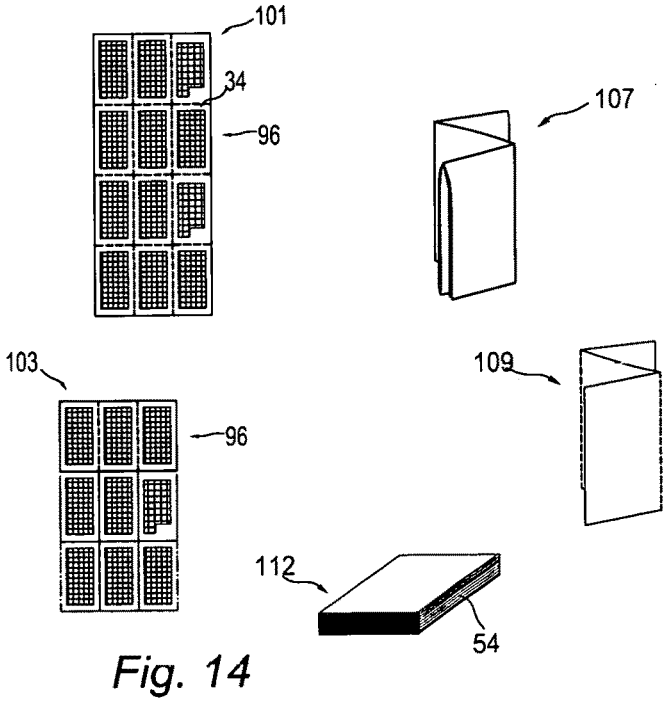
FIGS. 14 and 15 show parts of the strip of FIG. 13, respective-changes and parts of books during the process of the invention.
Figure 15:
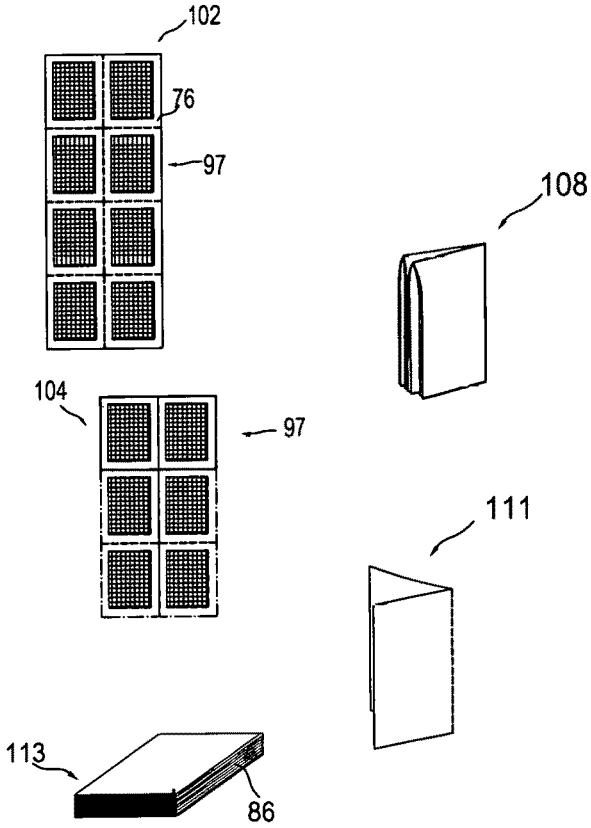
Figure 16:
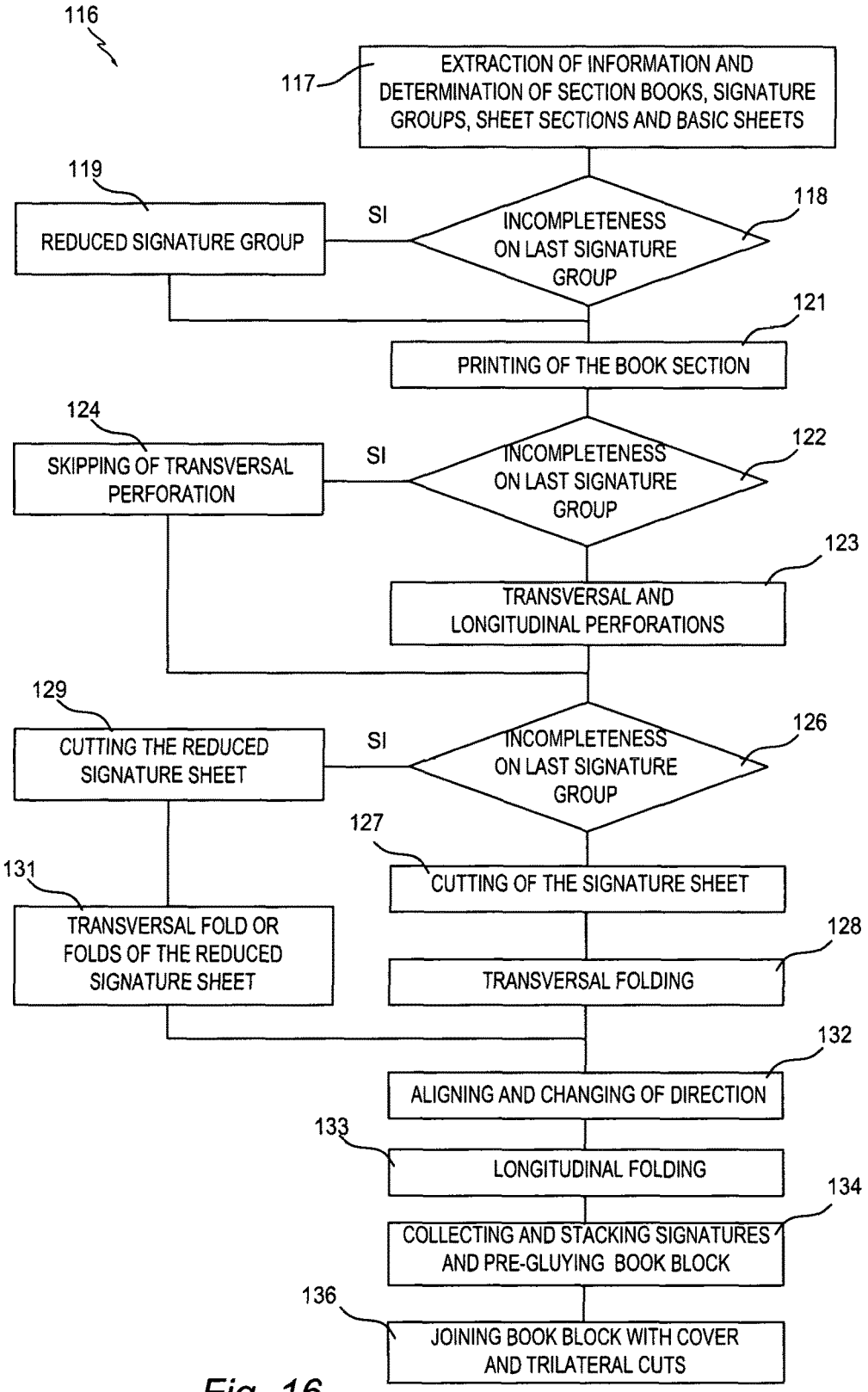
FIG. 16 represents a flow diagram of the process for the production of books in accordance with the invention.

With reference to the FIGS. 13-15, for signatures with more transversal folds, the paper strip 87 presents a book section 91 with signature groups 92 of twelve basic sheets 34 and, in sequence, a book section 93 with signature groups 94 of eight basic sheets 76. Also the book sections 91 and 93 define the start areas "St" and the program 58 identifies sheet sections 96, 97 formed by the respective basic sheets 34 and 76 and separable from the strip 87 with a single cut of the cutting equipment 41: each sheet section 96 is constituted by three basic sheets 34, while each sheet section 97 is constituted by two basic sheets 76.

In the case of incompleteness, the program 58 defines in the book section 91, 93, as last signature group, a reduced signature group 98, 99 including a number of sheet sections 96, 97 with at least a page of text and/or figures. Thus, the reduced signature groups 98 and 99 can be formed from one to three sheet sections 96, 97 and the program makes print in the book section 91, 93 a respective code of incompleteness, of identification of these features.

For the book section 91, 93, the perforating equipment 39 selects the longitudinal perforation disks for defining the longitudinal perforations 64 and 66 or the single longitudinal perforation 79 for the weakening lines on the signature groups 92 and 94 and on the reduced signature groups 98 and 99. On the contrary, the transversal perforations are limited only to the weakening lines provided for the folds of the signatures. In turn, the cutting equipment 41 separates from the continuous strip 87 the signature groups 92 and 94 as signature sheets 101 and 102 with twelve and, respectively, eight basic sheets for books in 24° and in 16°, while the reduced signature groups 98, 99 are separated as reduced signature sheets 103 and 104 from one to three sheet sections 96, 97, from three to nine basic sheets 34 and from two to six basic sheets 76.

The transversal folding equipment 46 executes only the complete transversal folds on the signature sheets 101 and 102, while it executes one or two transversal folds on the reduced signature sheets 103 and 104 with two or three sheet sections 96, 97 or, respectively, skipping the transversal folds in the case of reduced signature sheets constituted by a single sheet section 96, 97.

After the passage through the transversal folding equipment 46 and the change of direction, the longitudinal folding equipment 47 executes two longitudinal folds or a single longitudinal fold on the signature sheets 101 or 102, forming respective signatures 107 and 108. In a similar way, the equipment 46, executes two longitudinal folds or a longitudinal fold on the reduced signature sheets 103 or 104, either folded or unfolded, if present, forming respective signatures with reduced number of basic sheets 109 and 111.

Thereafter, the program 58 proceeds as for the books having signatures with a single transversal fold, by collecting and stacking the signatures 107 and 108 and the signatures with reduced number of sheets 109 and 111 to complete basic book blocks represented with 112 and 113.

With the above mentioned structures or functionally similar structures, the manufacturing system 21 can produce, with different formats and from a same continuous strip, books "on demand" having different signatures and maintaining the limitation on the number of white pages in the last signature. It is performed without mechanical changes on the system and without any arrest between a book and another. Thus, for instance, the system 21 can fulfill orders, in sequence and without intervention of operators, for a book with signatures in 8° or in 16° and height of 8", for a book with signatures in 8° or in 16° and height of 9" and for a book with signatures in 12° or in 24° and height of 9".

The process for the production of books with digital printing and technique by signatures, represented with 116 in FIG. 13, includes therefore the following steps: Extracting from the database of the system 21 the information on the book to be manufactured, block 117, with the data on the format of the book, association of the data to be printed of the book with the book section 32, 73, 89, 91. The block 117 also provides the definition of the number SBN of signature groups 33, 74, 93, 94 of the book section so that each signature group 33, 74, 93, 94 is formed by a number SSN, of six, four, twelve or eight basic sheets 34, 76 and the definition of the sheet sections 96, 97 formed by basic sheets separable from the strip with a single cut.

Checking, in a decision box 118, the condition of incompleteness on the last signature group 33, 74, 93, 94. In case of incompleteness, the program 58 defines in a block 119, as last element of the book section 32, 73, a halved signature group 59, 78 or, respectively, a reduced signature group 98, 99 with at least a page of text and/or figures. Namely the halved signature group 59, 78 having a half of the basic sheets 34, 76 and the reduced signature group 98, 99 having ⅓ or ⅔ of sheet sections 96, 97.

In a block 121, the program activates the printing equipment 31, for printing texts and/or figures in the pages of the book section 32, 73, 89, 91, the control codes for the other components of the system and the code of incompleteness in the case of existence of the halved signature group 59, 78 or the reduced signature group 98, 99.

In a decision box 122, the program 58 checks the condition of incompleteness of the signature group to be perforated. In a negative case, the program executes the longitudinal perforations 64 and 66 or the single longitudinal perforation 79 and the transversal perforation or perforations, block 123 in dependence on the typology of signature and the format of the book 22 or 72. In presence of incompleteness, block 124, the equipment 39 executes the longitudinal perforations or the single longitudinal perforation on the halved signature group 59, 78 or the reduced signature group 98, 99 and skips the transversal perforation, not necessary, or limiting the perforations to the parts required for the folds.

In a decision box 126, the program 58 checks the condition of incompleteness of the signature sheet or the signature sheet halved or of the signature sheet reduced in transit. In negative case, block 127, the program 58 activates the cutting equipment 41 for separating from the strip 23 the signature sheet 42, 77, 101, 102 and proceeds with the activation of the transversal folding equipment for one or more folds, block 128.

If, decision box 126, the condition of incompleteness of the signature group is recognized, the program activates the cutting equipment 41, block 129, for separating from the continuous strip 23 the halved signature sheet 62, 78 or the reduced signature sheet 103, 104 and proceeds by skipping the activation of the transversal folding equipment 46 or executing a reduced number of folds, block 131.

The signature sheet or the halved signature sheet or the reduced signature sheet emerging from the transversal folding equipment 46, folded or unfolded, is aligned by the aligning and direction changing device 49, block 132, and transferred into the longitudinal folding equipment 47 for the longitudinal fold and the formation of the signatures 48, 77, 107, 108 or the signatures with halved number of sheets 63, 83, or the signatures with reduced number of sheets 109, 111, block 133.

The procedure of production continues with the collection and the stacking of the signatures in the collecting and transferring device 51 and in the stacking and gluing device 52, block 134, with formation of the basic book block 53, 84, 112, 113. Thereafter, the basic book block is shifted into the conveyer belt 56, block 136, for the following treatments of binding with the cover and trilateral cuts for separating of the edges with elimination of the folds and equalization of the edges in the book.

Second Embodiment of the Invention

Figure 17:
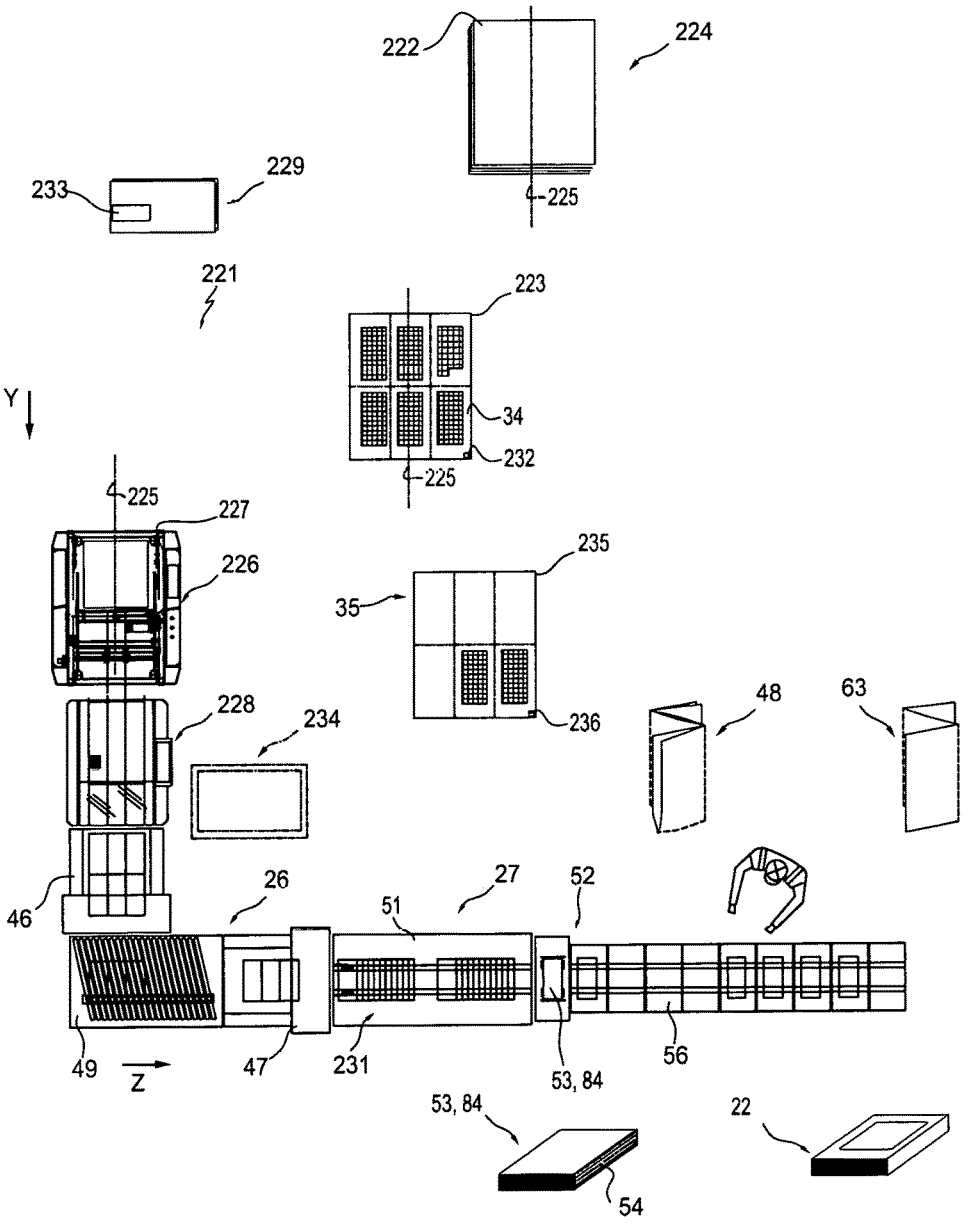
FIG. 17 represents a schematic plan view of a book manufacturing system with digital printing from cut sheets in accordance with a second embodiment of the invention.

FIG. 17 shows a book manufacturing system 221 according to a second embodiment of the invention. The system 221 manufactures the books 22 with digital printing on cut paper sheets 222 of origin for signature sheets 223 and the technique by signatures. The cut sheets 222 are arranged in a stack 224, are singularly separated from the stack along a longitudinal axis 225 and, after the printing, are transversally and, if required, longitudinally folded.

Figure 18:
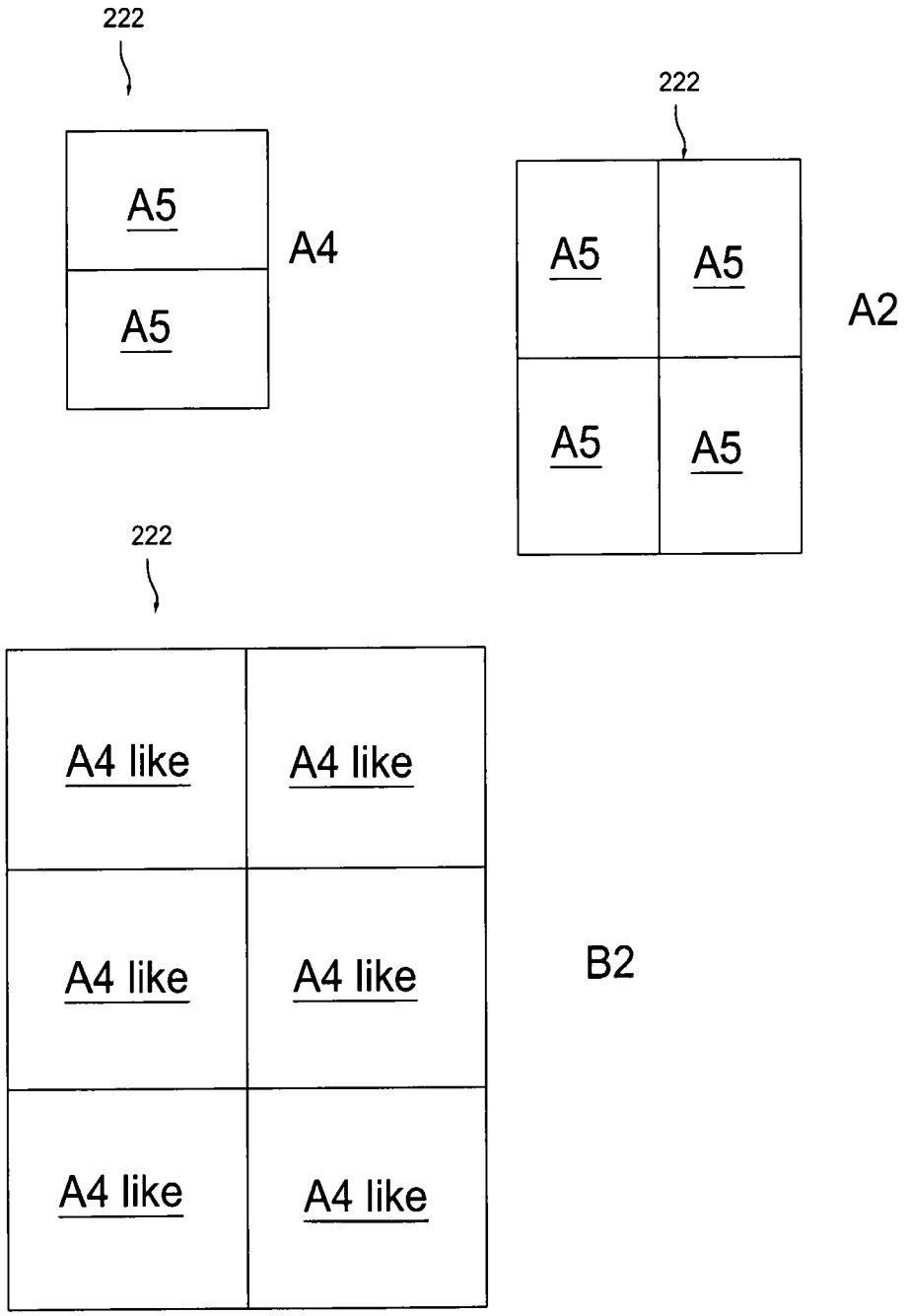
FIG. 18 is a sketch of exemplary type of cut sheets used in the book manufacturing system of FIG. 17.

As non-limiting example, the cut sheets 222 can be of ISO paper sizes "A4" [297×210 mm] and "A3" [420×297 mm] (FIG. 18). Also paper sizes of "B2" [500×707 mm] type have useful employment in the system 221. The "A4" sheets can be of origin for a signature group with two basic sheets of "A5" type signature without longitudinal fold and a single transversal fold. The "A3" sheets can be of origin for a signature group with four basic sheets of an "A5" type signature with a longitudinal fold and a transversal fold. In turn, the "B2" sheets can be of origin for a signature group with six basic sheets similar to an "A4" type signature with a longitudinal fold and two transversal folds. The system can also operate with stacks of different typologies.

In summary, the book manufacturing system 221 comprises a printing station 226 with a magazine 227 for the stack 224, a perforating and cutting station 228, and other kinematic components identical to the ones of the system 21 including the dynamic signature forming station 26 with the transversal folding equipment 46 and the longitudinal folding equipment 47 and the collecting and pre-assembling station 27. The system 221 operates on the basis of information on the books to be printed, supplied from a database, and a program 229 comprising parts of coordination and control for the stations 227, 228, 26 and 27.

The printing station 226 is of a high-speed type and provides for individually separating the cut sheets 222 from the stack 224 and digitally printing text and figures of the books to be manufactured on the two sides of the sheets 222 and constituting the signature sheets 223.

In extreme synthesis, the program 229 controls the printing station 226 so as to define book sections 231 on a given number of signature sheets 223 containing the data of the text and figures of the books to be manufactured. Each book section 231 is associated to the specific book 22 and includes the number SBN of the signature groups. Each signature group is generally formed by a given number SSN of the basic sheets 34 with printed text and/or figures on the two sides of the cut sheets 222.

The data of each book section 231 are also printed as a book section code 232 on a margin of each signature sheet 223 for reading by sensors (not shown) of the system 221. In alternative, the printing station 226 is interfaced with the other functional components of the system and transmits operative information to the functional components on the basis of the data of the book sections 228.

According to the invention, the manufacturing system 221 operates with an optimization program 233, which is integrated with the program 229 for controlling the printing station 226, the perforating and cutting station 229 and the signature forming station 26 so as to reduce or avoid the number of sheets devoid of texts and/or figures in the signatures of the book 22 to be manufactured. Further, the perforating and cutting station 228 comprises a discard diverting and storage device 234 for diverting and storing blank parts of the signatures.

Specifically, the program 233 checks the existence of incompleteness if a signature sheet 235 of the last signature group has sheet sections 35 devoid of texts and/or figures, which would result in a final signature with one or more sheet sections 35 having only blank pages. In the case of incompleteness, the program 233 controls the printing station 226, for printing on the signature sheet 235 an identification code representative of a reduced signature group as a specific book section code 236. In the alternative solution, the printing station 226 transmits to the functional components the specific instruction for the processing of the reduced signature group.

After the printing, the perforating section of the station 228 perforates the cut sheet 222 in the longitudinal direction, if the signature sheet provides longitudinal folds, and in the transversal direction along weakening lines of the basic sheets for the easy folding of the sheets as for the manufacturing system 21. The following folds of the signature sheets 223 are effected as for the signature sheets 42.

If the condition of incompleteness is recognized in last signature sheet 235, the program 233 activates the cutting section of the station 228 for separating from the signature sheet 235 the blank portion 35, discarding this portion by means of the diverting and storage device 234 and proceeds by skipping the activation of the transversal folding equipment 46 or executing a reduced number of folds and the other operations as for the system 21.

As alternative, if the printing station 226 can process more book sections 231 in sequence on a same stack 224, the last signature sheet of a given book can include the first basic sheets of a following book. In this case, the programs 229 and 233 are such to provide the transversal cutting of the last signature sheet, its folding and the further process of collection and stacking. The printing station 226 is temporary arrested and the system starts the manufacturing of the following book with the first signature constituted by a a reduced signature group.

Figure 19:
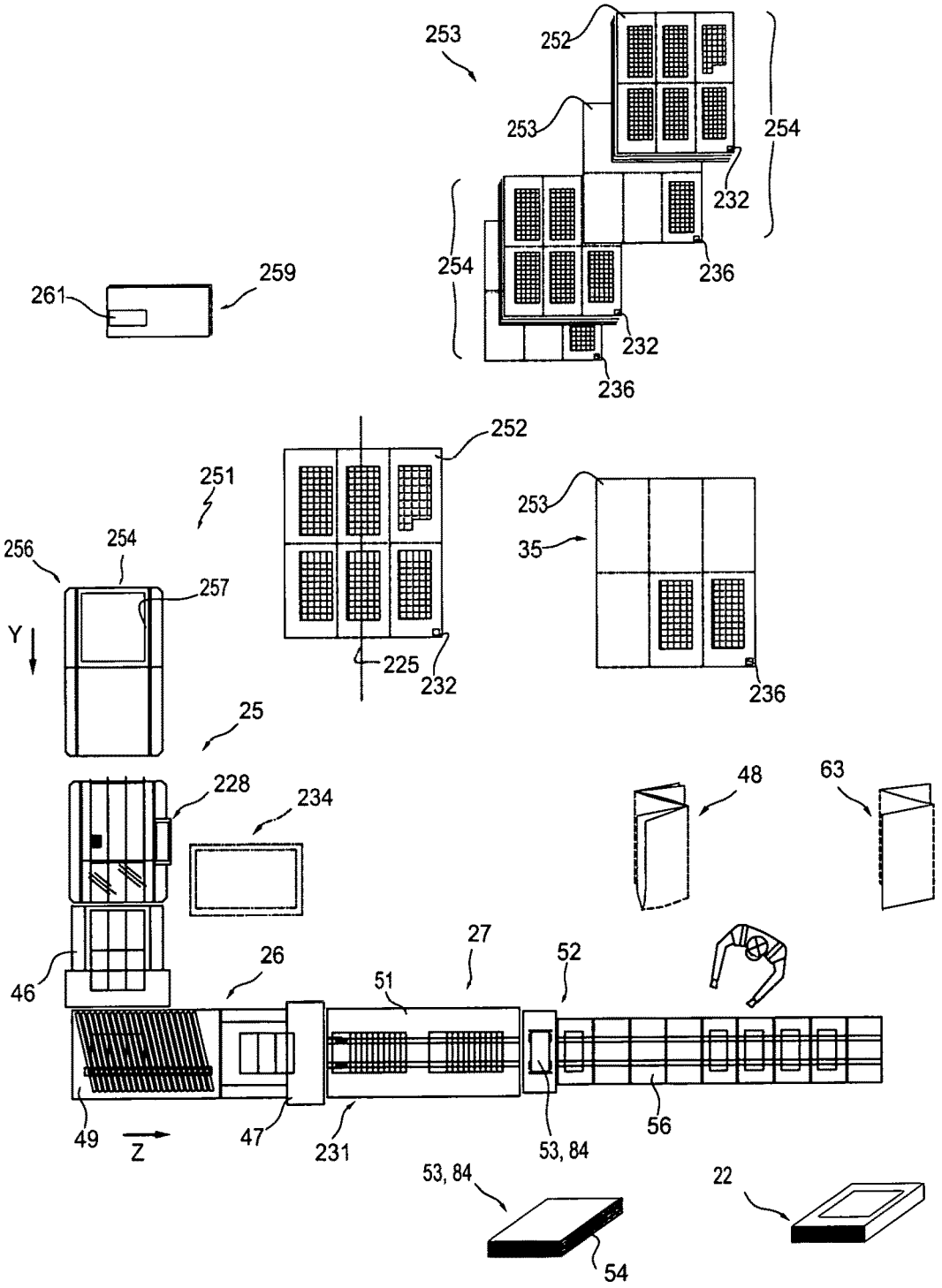
FIG. 19 represents a schematic plan view of a book manufacturing system with digital printing from individual sheets in accordance with an alternative to the system of FIG. 17.

FIG. 19 shows a book manufacturing system 251 according to a variant of the second embodiment of the invention of FIG. 17. The system 251 uses signature sheets 252 with a last signature sheet 253 which have been previously printed by an off line printer. The signature sheets 252 are similar to the signature sheets 223 with text and figures and the respective book section codes 232 and 236.

The signature sheets 252 are arranged in a stack 253 for more books, each associated to a stack book sections 254 similar to the the book sections 32 of the system 21.

The manufacturing system 251 comprises a storing and feeding equipment 256 with a magazine 257 for the stack 254, and the other operative components of the system 221 including the perforating and cutting station 228, the dynamic signature forming station 26, the transversal folding equipment 46, the longitudinal folding equipment 47 and the collecting and pre-assembling station 27. The system 251 operates on the basis of information on the books to be printed, supplied from the database, and a program 259 of coordination and control for the stations 256, 26 and 27 and an optimization program 261 similar to the program 233.

The operation of the manufacturing system 251 is similar to the one of the system 221 and it will not be repeated here.

Naturally, the principle of the invention remaining the same, the embodiments and the details of construction can broadly be varied with respect to what has been described and illustrated, by way of non-limitative example, without by this departing from the ambit of the present invention.

The invention claimed is:

1. A process for the production of books with digital printing from signatures, wherein each of said books comprises a number of signature groups, each formed with a given number of basic sheets, said basic sheets are parts of respective signature sheets forming the signature groups and said signature sheets define respectively a longitudinal axis, and wherein said process employs a system for manufacturing books comprising a transversal cutting equipment for cutting transversally the signature sheets and a transversal folding equipment for folding transversally the signature sheets with respect to the longitudinal axis, said process comprising the following steps:

a) identifying in said signature groups a reduced signature group including a number of sheet sections having at least a page with text and/or figures for a book in which the part regarding a last signature group has at least a sheet section devoid of text and/or figures of the book to be manufactured;

b) actuating the transversal cutting equipment for cutting a last sheet of the signature sheets so as to separate, as reduced signature sheet, the sheet section having at least a page with text and/or figures;

c) processing the reduced signature sheet for a signature with reduced number of sheets by actuating the transversal folding equipment limited to the sheet sections having at least a page with text and/or figures or skipping the actuation of the transversal folding equipment for a single sheet section; and d) stacking the signature with reduced number of sheets on the other signatures for completing a basic book block of the book to be manufactured.

2. Process for the production of books according to claim 1, wherein the system for manufacturing books comprises a longitudinal folding equipment for folding longitudinally signature sheets transversally folded in order to form said signatures preparatory to a basic book block and wherein, after the step c), said process comprises the step:

c1) actuating the longitudinal folding equipment for longitudinal folding the reduced signature sheet, as signature with reduced number of sheets.

3. Process for the production of books according to claim 2, wherein the system for manufacturing books comprises a perforating equipment for perforating the signature sheets, for each basic sheet, along a longitudinal direction parallel to said longitudinal axis and a transversal direction perpendicular to said longitudinal axis and wherein, before the step b), said process comprises the step:

a1) actuating the perforating equipment for perforating the signature groups and, if present, the reduced signature group in weakening lines thereof provided for the folds of the signatures.

4. Process for the production of books according to claim 1, wherein said signature sheets are obtained from individual cut sheets.

5. Process for the production of books according to claim 4, wherein said cut sheets are blank sheets and the system for manufacturing books further comprises a printing device for both sides of the cut sheets and wherein, before the step a), said process comprises the step of controlling the printing device for printing text and/or figures on said cut sheets to constitute the basic sheets of the book to be manufactured and control codes including information on the existing of incompleteness in the last signature group, of control for the transversal cutting equipment and the transversal folding equipment.

6. Process for the production of books according to claim 4, wherein each signature sheet includes a control code with data associated to the respective book section and the last signature sheet includes an identification code as a specific control code associated to the reduced signature sheet and wherein, in the step a), the identification of the reduced signature group is effected in response to information from said identification code.

7. Process for the production of books according to claim 4, wherein the last signature group, as reduced signature sheet, comprises a section devoid of text and/or figures, the system for manufacturing books further comprises a discard and storing device and wherein, after the step b) the process comprises the step:

b1) actuating the discard and storing device for discarding the section of signature sheet devoid of text and/or figures.

8. Process for the production of books according to claim 4, wherein the cut sheets are arranged in a stack including more book sections in sequence for more books and a last signature group of a given book section of a given book includes a remaining sheet section with text and/or figures of another book section of a following book, wherein the step d) completes the basic book block of said given book and wherein, after the step d) the process comprises the step:

d1) starting the manufacturing of the following book with the first signature constituted by said remaining sheet section.

9. Process for the production of books according to claim 1, wherein the system for manufacturing books uses printed cut sheets including text and figures of more books, wherein said printed cut sheets are arranged in a stack with book sections in sequence for respective books and wherein said system further comprises a storing and feeding equipment for storing said stack and individually separating the sheets from said stack.

10. Process for the production of books according to claim 1, wherein said cut sheets are of A3 or A4 typologies for basic sheets of A5 typology.

11. A system for manufacturing books printed on cut sheets, comprising a perforating equipment for longitudinal and transversal perforations of the cut sheets, a transversal cutting equipment, a transversal folding equipment, a longitudinal folding equipment and a stacking device, wherein each book comprises a number of signature groups, each formed with a given number of basic sheets, said basic sheets are parts of respective signature sheets forming the signature groups and said signature sheets are constituted by the cut sheets, said cut sheets are arranged in a stack for different books and in which the transversal folding equipment and, if requested, the longitudinal folding equipment are actuatable for transversal and longitudinal folds of the signature sheets, said system further comprising a program such to:

a) identifying in said signature groups a reduced signature group including a number of sheet sections having at least a page with text and/or figures, for a book in which the part regarding a last signature group has at least a sheet section of the last signature sheet devoid of text and/or figures of the book to be manufactured;

b) actuating the perforating equipment for perforating the signature groups and, if present, the reduced signature group in weakening lines provided for the folds of the signatures;

c) actuating the transversal cutting equipment for cutting a last sheet of the signature sheets so as to separate, as reduced signature sheet, the sheet section or the sheet sections having at least a page with text and/or figures;

d) processing the reduced signature sheet for a signature with reduced number of sheets by actuating the transversal folding equipment limited to the sheet sections having at least a page with text and/or figures or skipping the actuation of the transversal folding equipment for a single sheet section;

e) actuating, if requested, the longitudinal folding equipment for longitudinal folding or leaving longitudinally unfolded the reduced signature sheet, as signature with reduced number of sheets; and f) stacking the signature with reduced number of sheets on the other signatures for completing a basic book block of the book to be manufactured.

12. System for manufacturing books according to claim 11, wherein the sheet section devoid of text and/or figures of the book to be manufactured is a blank section and said system further comprises a discard and storing device, and wherein, after the step c) the process comprises the step:

c1) actuating the discard and storing device for discarding the blank section of signature sheet devoid of text and/or figures.

13. System for manufacturing books according to claim 11, wherein the last signature sheet devoid of text and/or figures of the book to be manufactured includes another sheet section with text and/or figures of another book section of a following book, wherein the step f) completes the basic book block of said book to be manufactured and wherein, after the step f) the process comprises the step g): starting the manufacturing of the following book with the first signature constituted by said other sheet section.

14. System for manufacturing books according to claim 11, wherein said cut sheets are blank sheets and further comprises a printing device for both sides of the cut sheets of the stack and wherein, before the step a), said process comprises the step of controlling the printing device for printing text and/or figures on said cut sheets to constitute the basic sheets of the book to be manufactured and control codes including information on the existing of incompleteness in the last signature group, of control for the transversal cutting equipment and the transversal folding equipment.

15. System for manufacturing books according to claim 11, wherein said system uses printed cut sheets including text and figures of more books and said stack includes more book sections in sequence for respective books and wherein said system further comprises a storing and feeding equipment for storing said stack and individually separating the sheets from said stack.

16. System for manufacturing books according to claim 15, wherein said system uses printed cut sheets including text and figures of more books and said stack includes more book sections in sequence for respective books and wherein each signature sheet includes a control code with data associated to the respective book section and the last signature sheet includes an identification code as a specific control code associated to the reduced signature sheet, and wherein and wherein, in the step a), the identification of the reduced signature group is effected in response to information from said identification code.

* * * * *